US006054814A

United States Patent [19]

Constable

[11] Patent Number: 6,054,814

[45] Date of Patent: Apr. 25, 2000

[54] CAMERA FLASH CHARGING APPARATUS FOR LOW COST SINGLE USE CAMERA

[75] Inventor: Douglas W. Constable, Rochester, N.Y.

[73] Assignee: Eastman Kodak Company, Rochester, N.Y.

[21] Appl. No.: 09/149,688

[22] Filed: Sep. 8, 1998

[51] Int. Cl.[7] ..... H05B 37/02; H05B 41/32

[52] U.S. Cl. ..... 315/241 P; 315/241 S; 396/6

[58] Field of Search ..... 315/241 P, 241 S, 315/200 A; 396/6, 202

[56] References Cited

U.S. PATENT DOCUMENTS

| | | | |
|---|---|---|---|
| 4,942,340 | 7/1990 | Ikawa | 315/241 P |
| 5,432,410 | 7/1995 | Yamada et al. | 315/241 P |
| 5,574,337 | 11/1996 | Dunsmore | 315/241 P |
| 5,634,153 | 5/1997 | Constable | 396/206 |
| 5,729,774 | 3/1998 | Constable | 396/206 |
| 5,761,541 | 6/1998 | Constable et al. | 396/6 |
| 5,780,976 | 7/1998 | Matsuo | 315/241 P |
| 5,784,658 | 7/1998 | Hata et al. | 396/311 |

*Primary Examiner*—Don Wong
*Assistant Examiner*—Wilson Lee
*Attorney, Agent, or Firm*—Francis H. Boos, Jr.

[57] ABSTRACT

In a flash circuit for a single use camera, a minimum residual charge voltage level is maintained on a flash capacitor to ensure availability of an energy source to operate an auxiliary circuit, such as an optical data recording circuit, even after prolonged periods of non-use of the camera. This minimum charge voltage level is maintained by provision of a DC circuit path from the camera battery via the charger circuit and flash power rectifier diode to the flash capacitor. Automatic restart of the flash charging circuit upon closing of the flash trigger switch is assured by connecting the charging circuit start terminal to the trigger switch by means of a normally reverse biased re-start diode that isolates the start terminal from the flash capacitor voltage on the trigger circuit at all times when the flash trigger switch is open. To avoid inadvertent start up of the flash charger during camera assembly when the battery is installed, an assembly process employs precharging of the flash capacitor to maintain the re-start diode in reverse biased mode during the assembly process.

4 Claims, 2 Drawing Sheets

CAMERA FLASH CHARGING APPARATUS FOR LOW COST SINGLE USE CAMERA

CROSS-REFERENCE TO RELATED APPLICATIONS

Cross-reference is made to commonly assigned, copending U.S. application Ser. No. 08/992,873, entitled CAMERA FLASH APPARATUS FOR LOW COST SINGLE USE CAMERA, filed Dec. 17, 1997 and to commonly assigned, copending U.S. application Ser. No. 08/822,094, entitled "OPTICAL DATA RECORDING CIRCUIT FOR A PHOTOGRAPHIC CAMERA", filed Mar. 20, 1997.

FIELD OF THE INVENTION

The invention relates to the field of flash circuits employed in low cost single use cameras and, in particular, to a flash circuit used to provide operating energy to an optical data bit recording circuit.

BACKGROUND OF THE INVENTION

Commonly assigned U.S. Pat. No. 5,574,337 discloses a "one touch" flash circuit useful in a single use camera. A flash charging circuit is initially started by depression of a "one touch" button which applies a forward bias potential to an input terminal coupled to a base terminal of an oscillation transistor to initiate self-regenerated oscillations used to charge a flash capacitor. The charging circuit continues oscillating even after the "one touch" button is released. When the flash capacitor is fully charged, a feedback circuit responsive to charge potential on the flash capacitor terminates the oscillations. When a picture is taken with flash operation, energy from discharging of the flash capacitor is fed back via the secondary winding of the step-up transformer to the base of the oscillation transistor of the flash charging circuit to drive the oscillation transistor into conduction thus restarting the self-regenerating oscillations.

In commonly assigned U.S. Pat. No. 5,634,153, there is disclosed a similar circuit in which a resistor is coupled between the base input terminal of the oscillator circuit to ground to suppress the possibility of static charge voltage initiating oscillator operation at undesired times. When the camera is in use but left idle for a period of time, such as two hours, the flash capacitor voltage declines to, for example, 200–240 volts. While this is sufficient to cause the flash tube to fire, the base resistor in the oscillator may, in some cases, prevent restart of the oscillator. To ensure restart of the oscillator after flash operation under these conditions, a feedback capacitor of appropriate size is coupled directly from the discharge terminal of the flash charge capacitor to the start input terminal of the charging circuit. While this circuit is fully effective for restarting oscillation when sufficient charge exists on the flash capacitor to cause firing of the flash tube, there are occasions when a picture is taken at a time when insufficient charge on the flash capacitor exists to fire the flash tube. This can occur when the camera is first used after a prolonged period of inactivity, e.g. several months, without first charging the flash capacitor. Without firing of the flash tube, i.e. the flash capacitor does not discharge, there is no energy pulse for feedback to the base of the oscillator transistor and thus no auto-restart of the flash charging cycle.

In the above cross-referenced application Ser. No. 08/992,873, a solution to this problem is described in which a resistor-capacitor restart feedback path is coupled between the flash trigger circuit and the charging circuit start input terminal. With this arrangement, a residual charge voltage on the flash capacitor of as low as eight volts, which also appears in the trigger, is sufficient to be differentiated by the resistor-capacitor feedback path at the time the shutter sync trigger switch is closed to restart oscillations in the charging circuit to thereby assure re-charging of the flash capacitor. It is true that the first picture taken after this prolonged period of non-use will not have the benefit of flash, but at least the next picture will have flash because of the automatic restart of the flash charging circuit.

The proper operation this auto-restart circuit is premised on the assumed fact that even after prolonged non-use, there will be sufficient residual charge left on the flash capacitor to create a feedback pulse to restart the charger. It has been found, however, that the self-discharge of the flash capacitor can completely eliminate any residual charge on the flash capacitor, going all the way down to a zero residual charge. In this event, there is insufficient charge voltage to create a feedback restart pulse when the first picture is taken.

In the above cross-referenced application Ser. No. 08/822,094, a data bit recording circuit is described in which energy to operate the recording is provided from energy stored in the flash capacitor. The recording circuit is capable of being operated at very low residual flash capacitor charge voltage levels. However, should the flash capacitor self-discharge down to a zero residual charge voltage, the recording circuit would not operate until the flash capacitor is recharged after taking the first picture.

There is therefore a need in such cameras for an arrangement that ensures that flash charger oscillation will automatically restart even in situations in which prolonged non-use of the camera results in a zero residual charge on the flash charge storage capacitor. Further, if the flash circuit is used to operate a data bit recording circuit, there is a need to ensure that there will be sufficient residual charge voltage to operate the recording circuit, even after prolonged non-use of the camera.

SUMMARY OF THE INVENTION

In accordance with the invention therefore, there is provided a flash circuit for use in a single use flash camera, wherein the flash circuit comprises a DC voltage power source having first and second power output terminals; a flash charge storage capacitor having a first terminal DC connected to the rectifier diode and a second terminal DC connected to the second terminal of the DC voltage power source; and a flash charging circuit including a self-oscillating circuit and a rectifier diode. In this aspect of the invention, the self-oscillating circuit is provided with a DC circuit connection between the power source and the rectifier diode and the rectifier diode is connected between the self-oscillating circuit and the storage capacitor in such a manner as to maintain a DC circuit connection between the power source and the storage capacitor when, through self-discharge, charge voltage on the storage capacitor falls below voltage on the first power output terminal of the power source. In this manner, a minimum charge voltage is maintained on the storage capacitor at approximately the voltage on the first power output terminal of the power source even after prolonged period of non-use of the camera.

In a further aspect of the invention, the flash circuit further includes a flash trigger circuit having a trigger switch and an optical data recording circuit coupled across said flash charge storage capacitor and trigger switch, the recording circuit being operative, in response to closure of said trigger switch, to effect optical data recording from energy stored in said flash charge storage capacitor. In this aspect of the invention, the minimum charge level maintained on said flash charge storage capacitor is available to power the optical data recording circuit even after said flash storage capacitor has self-discharged after said prolonged period of non-use of the camera.

In yet another aspect of the invention, the trigger switch has a terminal at a voltage level determined by charge storage on said flash charge storage capacitor. The flash charging circuit includes a charger start input terminal; further includes a charging circuit restart diode coupled in normally reverse biased manner between said trigger switch terminal and said charger start input terminal such that actuation of said flash circuit to create flash illumination at least momentarily forward biases said restart diode to cause said charger circuit to re-initiate oscillation in the flash charger circuit to recharge said flash storage capacitor.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
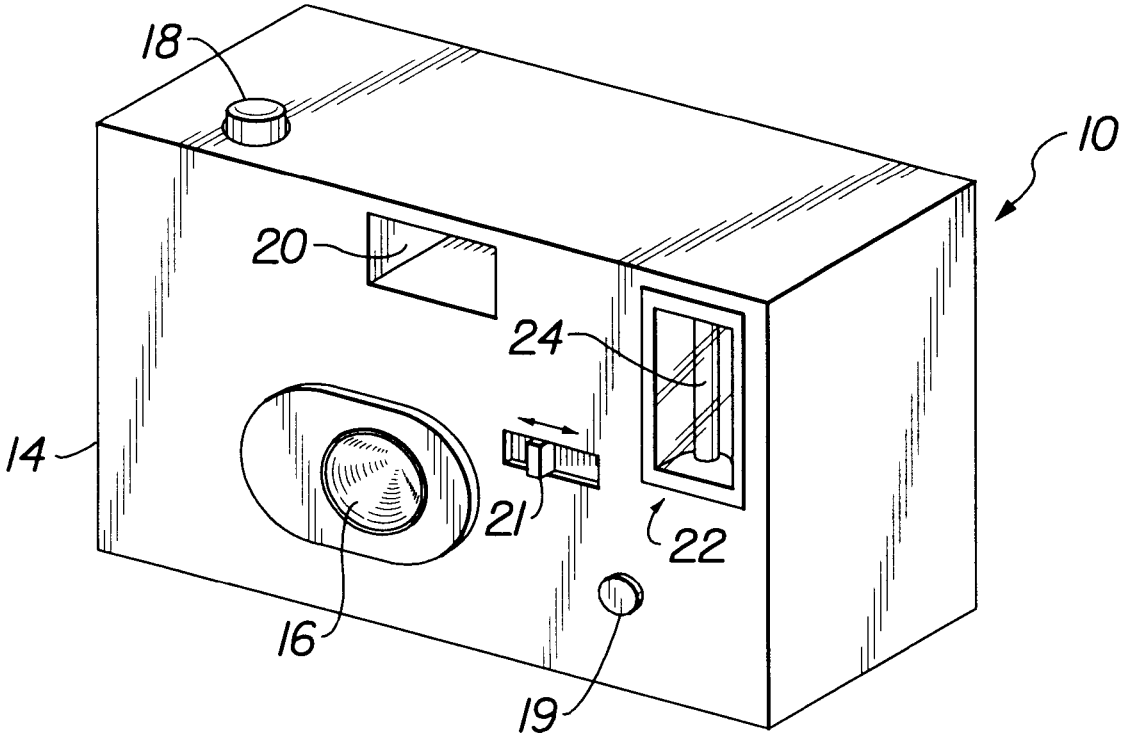
FIG. 1 is a diagrammatic illustration of a single use camera in which the present invention is particularly useful.

Referring to FIG. 1, there is depicted a low cost, single use camera 10 including a body 14, an optical system 16, a viewfinder 20 and a flash device 22 including a flash tube 24. A shutter button 18 initiates a picture taking sequence which opens and closes a shutter (not shown) to expose the film through optical system 16. Opening of the shutter also actuates an internal flash sync switch to a closed position, thereby initiating supplemental scene illumination from flash tube 24. A "one-touch" button 19, operable by the camera user, initiates a flash charging cycle to charge a flash capacitor to provide energy for operation of the flash tube 24. The camera is pointed at the intended subject with the aid of viewfinder 20. A switch 21 is provided for selection by the camera user of image frame aspect ratio data to be recorded on the film as will be described in more detail below.

Figure 2:
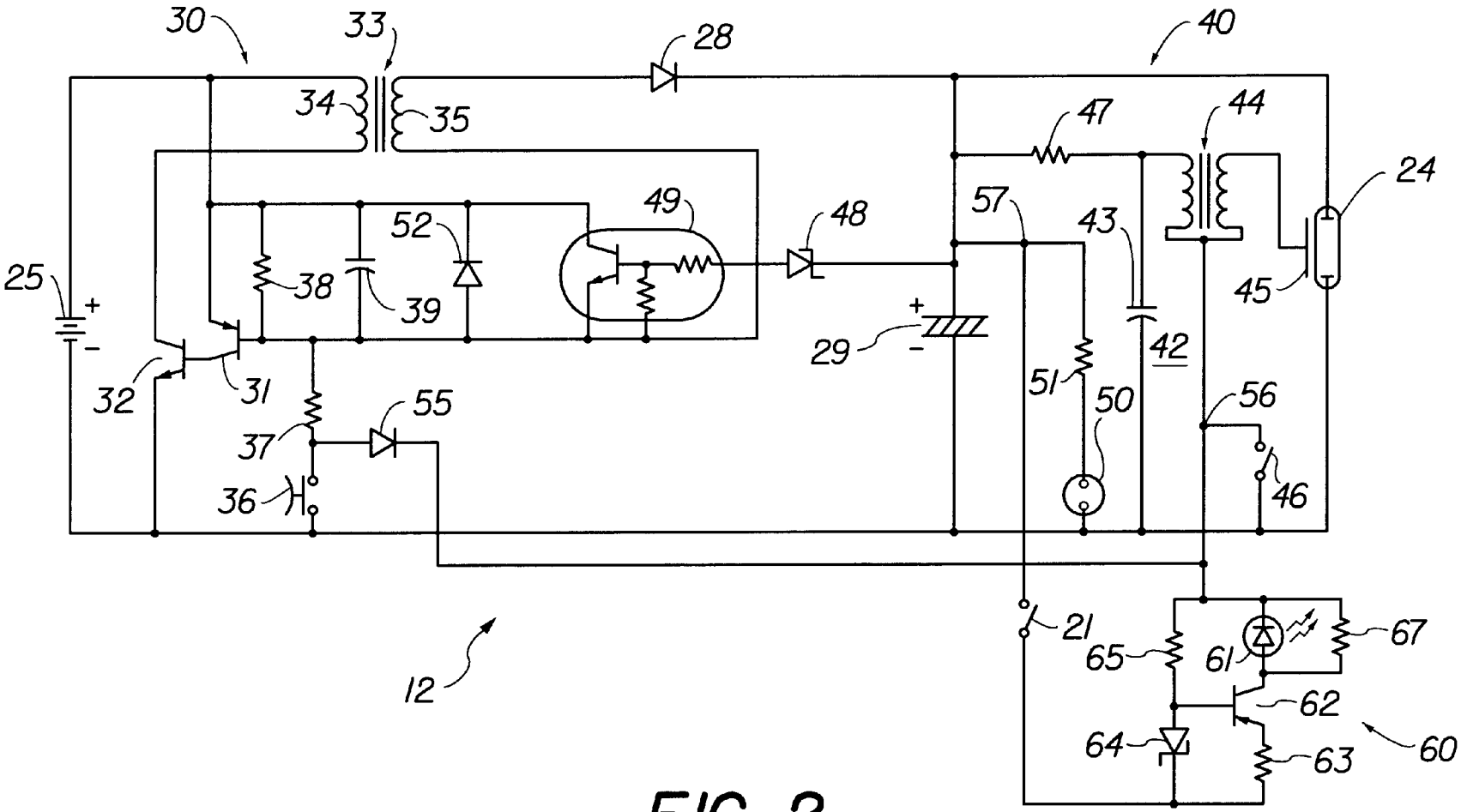
FIG. 2 is a circuit diagram of a camera flash circuit.

Turning now to FIG. 2, there is shown a circuit arrangement for the camera 10 comprising an auto-restart flash circuit 12 and an optical data recording circuit 60. As shown therein, flash circuit 12 includes a self-oscillating flash charging circuit 30 and a flash illumination circuit 40. Flash charging circuit 30 comprises first and second oscillating transistors 31,32, a step-up oscillation transformer 33 having primary winding 34 and secondary winding 35, and a rectifier diode 28. A manually operated, normally open, momentary switch 36, closable by depression of "one-touch" button 19 on camera 10, is coupled from the negative terminal of power supply battery 25 via a resistor 37 to the base of first oscillation transistor 31. When momentary switch 36 is closed, a positive potential is applied to the base of transistor 31 turning on both transistors 31 and 32 to initiate oscillatory pulses through primary winding 34. These pulses are stepped up in the secondary winding 35 and rectified by diode 28 to charge main flash capacitor 29. Feedback current from the secondary winding 35 sustains the oscillatory condition, even when "one-touch" button is released to open switch 36 thereby removing the positive bias on the base of transistor 31. A resistor 38 is connected between the base of transistor 31 and ground and serves to prevent the oscillation circuit 30 from commencing charging when exposed to static electricity. Resistor 38 holds the DC potential on the base of transistor 31 at the potential of the positive terminal of battery 25 when the oscillation circuit is off. Thus, any static electricity induced current that would otherwise flow through the junctions of transistors 31 and 32 is bypassed to the battery positive terminal and does not inadvertently start the charging circuit. The value of resistor 38 relative to that of resistor 37 is chosen to ensure that the bases of transistors 31 and 32 are forward biased when switch 36 is closed. Diode 52 protects the base-emitter junction of transistor 31 from reverse bias noise spikes.

Flash illumination circuit 40 includes flash capacitor 29, flash tube 24 and a flash trigger circuit 42 which comprises trigger capacitor 43, isolation resistor 47, voltage converting transformer 44, flash triggering electrode 45 and a flash trigger switch 46 which may comprise a shutter/flash sync switch which is closed when the camera shutter is opened by depression of camera shutter button 18. Trigger capacitor 43 is charged by current flow through charging transformer secondary winding 35 at the same time and in similar manner as flash capacitor 29. When switch 46 is closed during a picture-taking sequence, switch terminal 56, which is at the positive charge potential of flash capacitor 29, is pulled momentarily negative to the negative potential level of battery 25. Trigger capacitor 43 then discharges through the primary winding of voltage converting transformer 44, inducing a high voltage pulse of about 4.0 kilovolts in the secondary winding which is applied to triggering electrode 45. This causes ionization of the gas in flash discharge tube 24 resulting in flash capacitor 29 discharging through the flash tube 24, exciting the gas and producing flash illumination.

Neon light 50 and current limiting resistor 51 connected in series across flash capacitor comprise a ready light circuit to advise the camera user when sufficient charge is stored in capacitor 29, e.g. +270 volts, to sustain a flash illumination from flash tube 24. The flash circuit 40 also includes an oscillation arresting circuit comprising 320 volt zener diode 48 and an NPN switching transistor 49. When the flash capacitor charge voltage reaches full charge of +320 volts, zener diode 48 breaks down and momentarily conducts, applying a positive bias on the base of transistor 49. This drives transistor 49 into conduction shunting the base of oscillation transistor 31 to the positive terminal of battery 25. This turns off transistors 31, 32 thereby stopping the oscillation in the charging circuit 30. To automatically restart the oscillations in flash charging circuit 30 after taking a picture, a diode 55 has its anode connected via resistor 37 to the base of transistor 31 and its cathode connected to terminal 56 on the normally open contact side of trigger switch 46. Since, during normal use of the camera, there is always a positive potential at terminal 56 equal to or greater than the battery potential minus the forward drop of diode 28, diode 55 is normally in a reverse biased, "open", state. When trigger switch 46 is closed to initiate a flash picture, the cathode of diode 55 is connected momentarily to ground to forward bias the diode and draw current through the base-emitter junction of transistor 31, thereby starting oscillations in the flash charging circuit 30.

In the Advanced Photo System, there is provision for recording optical data bits on the film to indicate the format of the resultant photoprint that the camera user wants. For this purpose, the circuit of FIG. 2 includes an optical data recording circuit 60 that draws its operating energy from the energy stored in flash capacitor 29. To this end, circuit 60 comprises a light emitting diode (LED) 61 with its cathode connected to terminal 56 of the trigger circuit and its anode connected to the collector of PNP current switching transistor 62. The emitter of transistor 62 is connected via biasing resistor 63 and a data bit selector switch 21 to terminal 57 on the positive charge storage side of flash capacitor 29. A 3 volt zener diode 64 is connected across the base and emitter circuit of transistor 62. A zener diode bias resistor 65 is connected from the base of transistor 62 to the common terminal 56 between the cathode of the LED and the trigger circuit 42. A resistor 67 is connected directly across the LED to suppress false recording of an optical data bit if the selector switch is inadvertently closed during the brief interval of charging of the flash capacitor 29.

In normal operation of the recording circuit 60 with selector switch 21 closed, when trigger switch 46 is subsequently closed upon taking a picture, the voltage across flash capacitor 29 is momentarily applied across circuit 60. Zener diode 64 maintains a constant 3 volt forward bias across the base-emitter circuit of transistor 62 driving collector current through LED 61 to record an optical data bit on the film strip.

Normally, a residual voltage of as low as 2.5 volts on flash capacitor 29 is sufficient to operate the data bit recording circuit. However, after a prolonged period of non-use, e.g. several months or more, it is possible for the flash capacitor to self-discharge to a zero residual voltage. When this occurs, if the camera user neglects to precharge the flash capacitor by pressing the "one touch" button 19 to close momentary switch 36, it is possible for the user to inadvertently take a picture, with selector switch 21 closed to indicate a desired print format, and not get a corresponding data bit recorded on the film for that picture frame. This is in addition to failing to get flash illumination as well. However, because closure of the trigger switch forward biases diode 55, current is drawn through the base-emitter junction of transistor 31, automatically re-starting the flash charger circuit to recharge capacitor 29 in preparation for the next picture taking cycle. In order to preserve the ability to operate the optical data bit recording circuit even for the first picture taking cycle following a prolonged period of non-use of the camera, flash circuit 12 is structured to provide a DC path from the positive terminal of battery 25 to the flash capacitor 29. In this manner, the flash capacitor is always maintained at a minimum charge voltage level to assure that the optical data recording circuit will always operate, even when the user has failed to precharge the flash capacitor using the "one touch" 19 button on the camera. In the illustrated embodiment, this DC path comprises the positive terminal of battery 25, resistor 38, secondary winding 35, and rectifier diode 28 through the flash capacitor 29 and back to the negative terminal of battery 25. It will be noted that diode 28 is connected to charge flash capacitor 29 to a positive charge voltage. Should the charge voltage across capacitor start to fall below the level of the battery 25 voltage, diode 28 will become forward biased and the capacitor voltage will be at a minimum charge level equal to the battery voltage less one diode drop across rectifier diode 28. Assuming that battery 25 is a typical fresh alkaline battery with an unloaded output voltage of 3.2 volts, the minimum charge voltage on capacitor 29 would be maintained at about 2.8 volts which is the battery voltage less approximately a 0.4 volt diode drop across rectifier diode 28. The current drain on the battery to maintain this minimum charge voltage is negligible, on the order of 5 microamps.

While a minimum charge voltage of 2.8 volts on flash capacitor 29 is sufficient to operate the optical data recording circuit 60, it is insufficient to drive a resistor-capacitor pulse generating feedback path to restart oscillations in the flash charging circuit. For this reason, diode 55 is employed to connect the base of transistor 31 to the trigger switch 46. During normal camera operation, with a significant positive voltage on flash capacitor 29, diode 55 is reverse biased thereby isolating the flash charging circuit from flash illumination circuit while trigger switch 46 remains open. Upon closure of the trigger switch, diode 55 is forward biased to restart the self-oscillation circuit as described above.

From the foregoing, it can be seen that what has been described is a simple and low cost circuit for providing a minimum charge voltage on the flash capacitor to assure operation of an optical data recording circuit, even after prolonged periods of camera non-use in which the flash capacitor might normally self-discharge to a zero residual charge voltage. At the same time, by means of a simple diode coupled connection from the flash trigger switch, provision is made for automatically restarting flash charging circuit operation when the trigger switch is closed, while at all other times isolating the flash charging circuit from the flash illumination trigger circuit.

While the flash circuit disclosed herein advantageously maintains a minimum charge level on the flash capacitor to ensure operation of the optical data bit recording circuit and utilizes a normally reverse biased diode to ensure restart of the self-oscillation circuit when the trigger switch is closed, it has the possible disadvantage during camera assembly that insertion of batteries into the camera can cause unwanted start-up of the charging circuit, driving the flash capacitor to full charge and turning on the neon ready light. In certain circumstances, this can be a disadvantage during the assembly process. In accordance with another feature of the invention, this is avoided by causing the flash capacitor to be precharged to a voltage in excess of the battery 25 voltage so that, when the battery or batteries are inserted, an initial flash capacitor charging current is not created through the base-emitter of transistor 31 thereby avoiding start-up of the charging circuit at this stage of the camera assembly.

The invention has been described in detail with particular reference to certain preferred embodiments thereof, but it will be understood that variations and modifications can be effected within the spirit and scope of the invention.

PARTS LIST

| | |
|---|---|
| 10 | single use camera |
| 12 | flash circuit |
| 14 | camera body |
| 16 | optical system |
| 18 | shutter button |
| 19 | "one touch" button |
| 20 | viewfinder |
| 21 | print format selection switch |
| 22 | flash device |
| 24 | flash tube |
| 25 | power supply battery |
| 28 | rectifier diode |
| 29 | flash capacitor |
| 30 | flash charging circuit |
| 31 | oscillating transistor (MMBT3904LT1) |
| 32 | oscillating transistor (2SD879) |
| 33 | step-up oscillation transformer |
| 34,35 | transformer windings |
| 36 | momentary switch |
| 37 | resistor (1.5 Kilohm) |

-continued

| PARTS LIST | |
|---|---|
| 38 | resistor (22 Kilohm) |
| 39 | capacitor (1000 picofarad) |
| 40 | flash illumination circuit |
| 42 | flash trigger circuit |
| 43 | trigger capacitor (0.022 microfarad) |
| 44 | voltage converting transformer |
| 45 | flash triggering electrode |
| 46 | flash trigger (sync) switch |
| 47 | isolation resistor (1 Megohm) |
| 48 | zener diode (320 volt) |
| 49 | oscillation arresting transistor (MPSA2211) |
| 50 | neon ready light |
| 51 | current limiting resistor (3.9 Megohm) |
| 60 | optical data bit recording circuit |
| 61 | LED |
| 62 | transistor (2SA1780) |
| 63 | resistor (270 ohm) |
| 64 | zener diode (3 volt) |
| 65 | resistor (10 Kilohm) |
| 67 | resistor (2 Kilohm) |

What is claimed is:

1. A flash circuit for use in a single use flash camera comprising:

a DC voltage power source having first and second power output terminals;

a flash charge storage capacitor having a first terminal DC connected to the rectifier diode and a second terminal DC connected to the second terminal of the DC voltage power source; and a flash charging circuit including a self-oscillating circuit and a rectifier diode, the self-oscillating circuit having a DC circuit connection between the power source and the rectifier diode, the rectifier diode being connected between the self-oscillating circuit and the storage capacitor in such a manner as to establish a DC circuit connection between the power source and the storage capacitor when, through self-discharge, charge voltage on the storage capacitor reaches substantially the voltage on the first power output terminal of the power source thereby maintaining a minimum charge voltage on the storage capacitor at approximately the voltage on the first power output terminal of the power source even after prolonged period of non-use of the camera.

2. The flash circuit of claim 1 further including a flash trigger circuit, having a trigger switch, and an optical data recording circuit coupled across said flash charge storage capacitor and trigger switch, and responsive to closure of the trigger switch, to effect optical data recording from energy stored in said flash charge storage capacitor;

whereby said minimum charge voltage maintained on said flash charge storage capacitor is available to actuate said optical data recording circuit even after said flash storage capacitor has self-discharged after said prolonged period of non-use of the camera.

3. The flash circuit of claim 1 further including a flash trigger circuit having a trigger switch, the trigger switch having a terminal at a voltage determined by charge on said flash charge storage capacitor, said flash charging circuit including a charger start input terminal and a charging circuit restart diode coupled in normally reverse biased manner between said trigger switch terminal and said charger start input terminal such that actuation of said flash circuit to create flash illumination at least momentarily forward biases said restart diode to cause said charger circuit to re-initiate oscillation in the flash charger circuit to recharge said flash storage capacitor.

4. A method of assembling a camera having battery source of a predetermined voltage, a flash storage capacitor and a flash charging circuit which includes a DC circuit path from the battery source through the flash charging circuit to the flash storage capacitor to maintain a minimum level of charge on the storage capacitor, the method comprising:

precharging the flash storage capacitor, before insertion of the battery source, to a charge voltage in excess of the voltage level of the battery source thereby preventing start-up of the flash charging circuit upon insertion of the battery source into the camera.

* * * * *